US011802521B1

(12) United States Patent
Akimoto et al.

(10) Patent No.: US 11,802,521 B1
(45) Date of Patent: Oct. 31, 2023

(54) CYLINDER BLOCK AND COUPLING METHOD FOR WATER JACKET SPACER

(71) Applicant: TOYOTA JIDOSHA KABUSHIKI KAISHA, Toyota (JP)

(72) Inventors: Kazuki Akimoto, Nisshin (JP); Takashi Matsutani, Toyota (JP); Kou Shirakigawa, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 18/314,498

(22) Filed: May 9, 2023

(30) Foreign Application Priority Data

May 11, 2022 (JP) ..... 2022-078375

(51) Int. Cl.
*F02F 1/14* (2006.01)

(52) U.S. Cl.
CPC ..... *F02F 1/14* (2013.01)

(58) Field of Classification Search
CPC ..... F02F 1/14; F02F 1/10; F01P 3/02; F01P 7/14; F01P 2003/021; F01P 2007/143
See application file for complete search history.

(56) References Cited

U.S. PATENT DOCUMENTS

| | | | | |
|---|---|---|---|---|
| 11,261,822 | B1 * | 3/2022 | Craft | F02F 1/166 |
| 2015/0159540 | A1 * | 6/2015 | Misumi | F02F 1/16 123/41.44 |
| 2023/0220813 | A1 * | 7/2023 | Okuno | F02F 1/16 123/41.72 |

FOREIGN PATENT DOCUMENTS

| | | | | |
|---|---|---|---|---|
| EP | 1930564 | A1 * | 6/2008 | F02F 1/14 |
| JP | 2002-266695 | A | 9/2002 | |
| JP | 5610290 | B2 * | 10/2014 | F02F 1/14 |

* cited by examiner

*Primary Examiner* — Grant Moubry
(74) *Attorney, Agent, or Firm* — Finnegan, Henderson, Farabow, Garrett & Dunner, LLP

(57) ABSTRACT

A cylinder block includes a water jacket surrounding a cylinder of an internal combustion engine and a water jacket spacer disposed inside the water jacket. In the cylinder block, a direction toward a center of the cylinder in a radial direction of the cylinder is defined as an inner side. A direction away from the center in the radial direction of the cylinder is defined as an outer side. The water jacket spacer includes a spacer plate and a conversion portion protruding from the spacer plate in the radial direction. The conversion portion has an action surface on which a pressure of coolant flowing through the water jacket acts. The conversion portion converts a force applied to the action surface by the pressure of the coolant into a force pushing the spacer plate toward the inner side.

9 Claims, 8 Drawing Sheets

40 (22)
30 (21)
31
20

CYLINDER BLOCK AND COUPLING METHOD FOR WATER JACKET SPACER

BACKGROUND

1. Field

The present disclosure relates to a cylinder block and a coupling method for a water jacket spacer.

2. Description of Related Art

Japanese Laid-Open Patent Publication No. 2002-266695 discloses a structure for cooling a cylinder block of an internal combustion engine. In the structure for cooling the cylinder block, a water jacket spacer occupying a part of the water jacket is disposed inside the water jacket of the cylinder block.

The water jacket is continuous with the surroundings of all of multiple cylinders. The water jacket spacer is also continuous with the surroundings of all of the cylinders.

The width of the cross-section of the water jacket spacer in the radial direction of the cylinder is smaller than the width of the cross-section of the water jacket at a portion where the water jacket spacer is disposed. Further, a gap is provided between the water jacket spacer and an inner wall facing the cylinders in the inner walls of the water jacket.

In the structure disclosed in Japanese Laid-Open Patent Publication No. 2002-266695, the inner wall of the water jacket facing the cylinder is easily cooled by the coolant flowing between the water jacket spacer and the inner wall of the water jacket facing the cylinder.

When the inner wall of the water jacket facing the cylinder is cooled, the temperature of lubricating oil in the cylinders decreases and the viscosity of the lubricating oil increases. As a result, the friction between the pistons and the lubricating oil increases and the fuel efficiency of the internal combustion engine deteriorates.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure provides a cylinder block. The cylinder block includes: a water jacket surrounding a cylinder of an internal combustion engine; and a water jacket spacer disposed inside the water jacket. A direction toward a center of the cylinder in a radial direction of the cylinder is defined as an inner side. A direction away from the center in the radial direction is defined as an outer side. The water jacket spacer includes: a spacer plate; and a conversion portion protruding from the spacer plate in the radial direction. The conversion portion has an action surface on which a pressure of coolant flowing through the water jacket acts. The conversion portion is configured to convert a force applied to the action surface by the pressure of the coolant into a force pushing the spacer plate toward the inner side.

Another aspect of the present disclosure provides a coupling method for a water jacket spacer. The water jacket spacer is coupled to a water jacket disposed to surround a cylinder in a cylinder block of an internal combustion engine. A direction toward a center of the cylinder in a radial direction of the cylinder is defined as an inner side. A direction away from the center in the radial direction is defined as an outer side. A length of the water jacket in the radial direction is greater than a length of the water jacket spacer in the radial direction. The water jacket spacer includes: a first spacer plate; a second spacer plate; and a coupling portion that couples the first spacer plate to the second spacer plate. The second spacer plate is disposed on the outer side of the first spacer plate and spaced apart from the first spacer plate. The coupling portion includes: a first extension piece that extends toward the outer side from a first connection portion of the first spacer plate and extends upstream in a flow direction of the coolant in the water jacket; and a second extension piece that extends toward the outer side from an end of the first extension piece on the outer side, extends downstream, and is connected to a second connection portion of the second spacer plate. The first extension piece is configured to allow the end to move in the flow direction by pivoting around the first connection portion. The second extension piece is configured to allow the end to move in the flow direction by pivoting around the second connection portion. A sum of a length from the first connection portion to the end and a length from the second connection portion to the end is greater than a distance in the radial direction between an inner wall of the water jacket facing the first spacer plate and an inner wall of the water jacket facing the second spacer plate. The coupling method includes: inserting the water jacket spacer into the water jacket while providing a gap between the first spacer plate and the inner wall of the water jacket on the inner side and a gap between the second spacer plate and the inner wall of the water jacket on the outer side; and pushing the coupling portion from an upstream side to a downstream side to pivot the first extension piece and the second extension piece and force the first spacer plate and the second spacer plate so that the first spacer plate and the second spacer plate are separated from each other in the radial direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

First Embodiment

Hereinafter, a first embodiment of a cylinder block 10 will be described with reference to FIGS. 1 to 4.

Figure 1:
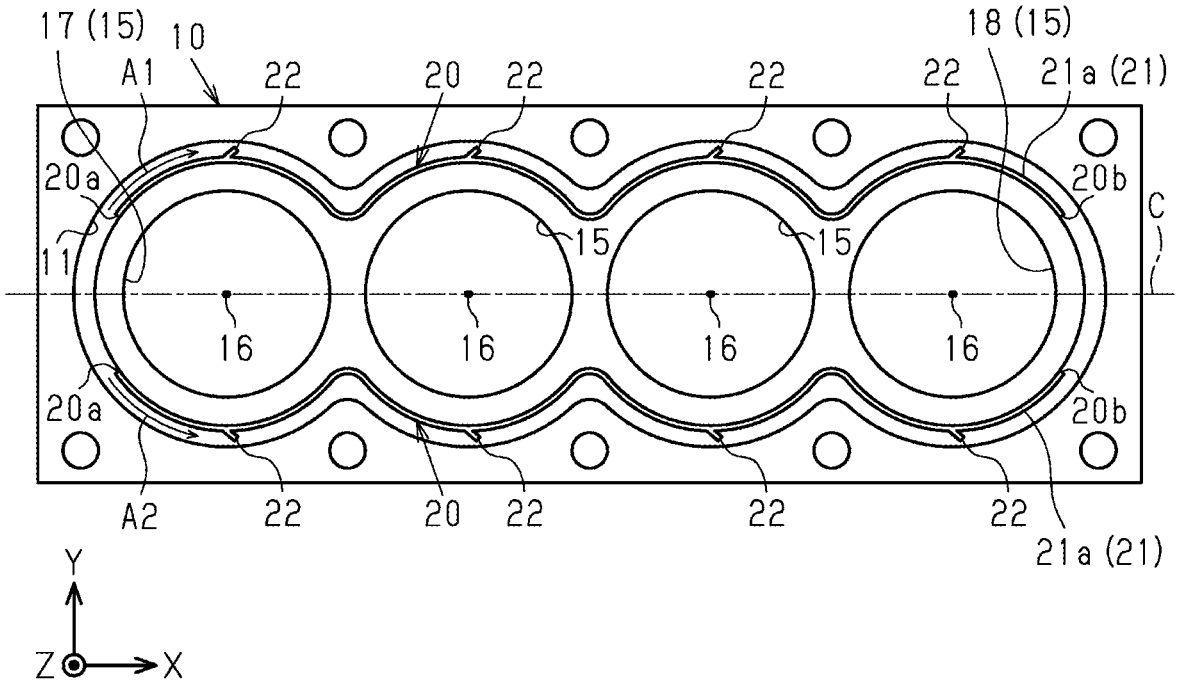
FIG. 1 is a plan view of a cylinder block according to a first embodiment.

As shown in FIG. 1, a cylinder block 10 of an internal combustion engine includes cylinders 15, a water jacket 11, and a water jacket spacer 20. The cylinder block 10 is made of metal. The cylinder block 10 has a rectangular shape in plan view, and has two long sides and two short sides.

Hereinafter, a long-side direction of the cylinder block 10 is referred to as a longitudinal direction X, a short-side direction of the cylinder block 10 is referred to as a width direction Y, and a direction orthogonal to the longitudinal direction X and the width direction Y is referred to as a height direction Z.

Cylinders 15

Four cylinders 15 are arranged straight in the longitudinal direction X of the cylinder block 10. The cylinder 15 located at one end in the arrangement direction of the cylinders 15 is referred to as a first cylinder 17, and the cylinder 15 located at the other end is referred to as a second cylinder 18. The cylinder 15 is a hole extending in the height direction Z, and has a circular shape having the center 16 in plan view.

Hereinafter, the direction toward the center 16 of each cylinder 15 in the radial direction of the cylinder 15 is defined as an inner side, and a direction away from the center 16 in the radial direction of the cylinder 15 is defined as an outer side.

Water Jacket 11

The water jacket 11 is disposed to surround the four cylinders 15. The water jacket 11 has a wavy shape curved in conformance with the shape of the outer periphery of the cylinder 15.

Figure 4:
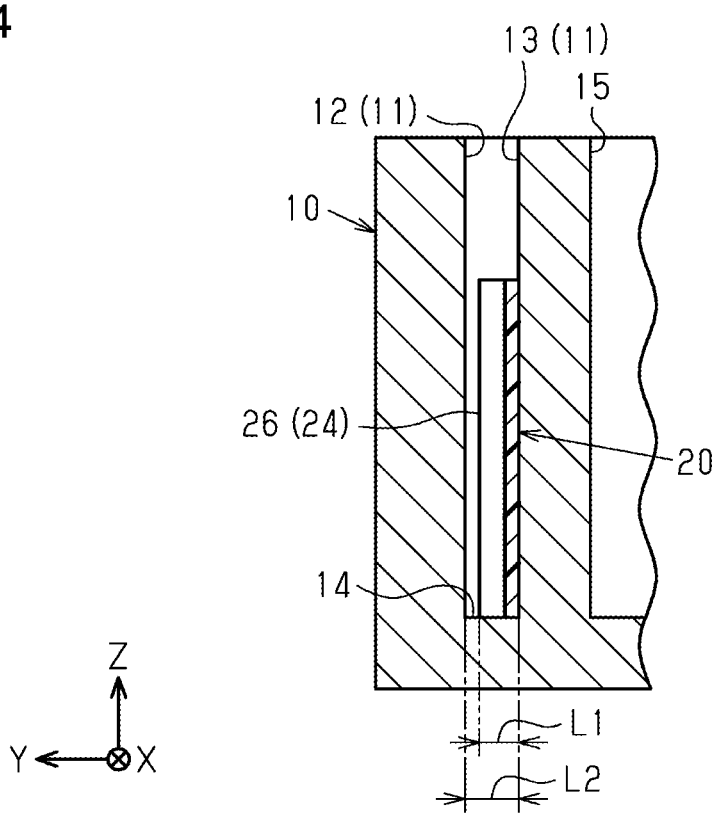
FIG. 4 is a cross-sectional view taken along line 4-4 in FIG. 3.

As shown in FIG. 4, the water jacket 11 is a hole extending in the height direction Z. The water jacket 11 includes an outer-side inner wall 12, which is an inner wall on the outer side, an inner-side inner wall 13, which is an inner wall on the inner side, and a bottom wall 14. The outer-side inner wall 12 and the inner-side inner wall 13 extend in the height direction Z. The outer-side inner wall 12 and the inner-side inner wall 13 face each other. The lowest point of the outer-side inner wall 12 and the lowest point of the inner-side inner wall 13 in the height direction Z are connected to each other by the bottom wall 14.

Coolant is supplied to the water jacket 11 from a coolant inlet (not shown) formed in a wall portion of the cylinder block 10. As indicated by arrows A1 and A2 in FIG. 1, the coolant flows from the left side to the right side and is discharged from a coolant discharge port (not shown). The arrow A1 indicates the flow direction of the coolant flowing on the upper side in FIG. 1, and the arrow A2 indicates the flow direction of the coolant flowing on the lower side in FIG. 1.

Water Jacket Spacer 20

As shown in FIGS. 1 to 4, the water jacket spacer 20 includes a spacer plate 21 and a conversion portion 22. The water jacket spacer 20 is made of resin.

As shown in FIG. 1, the water jacket spacers 20 are arranged one by one on the opposite sides in the width direction Y inside the water jacket 11 to be symmetrical with respect to a virtual straight line C passing through all the centers 16 of the four cylinders 15. Since the structures of the two water jacket spacers 20 are symmetric with respect to the virtual straight line C, the structure of one water jacket spacer 20 will be hereinafter described and the structure of the other water jacket spacer 20 will not be described.

Figure 2:
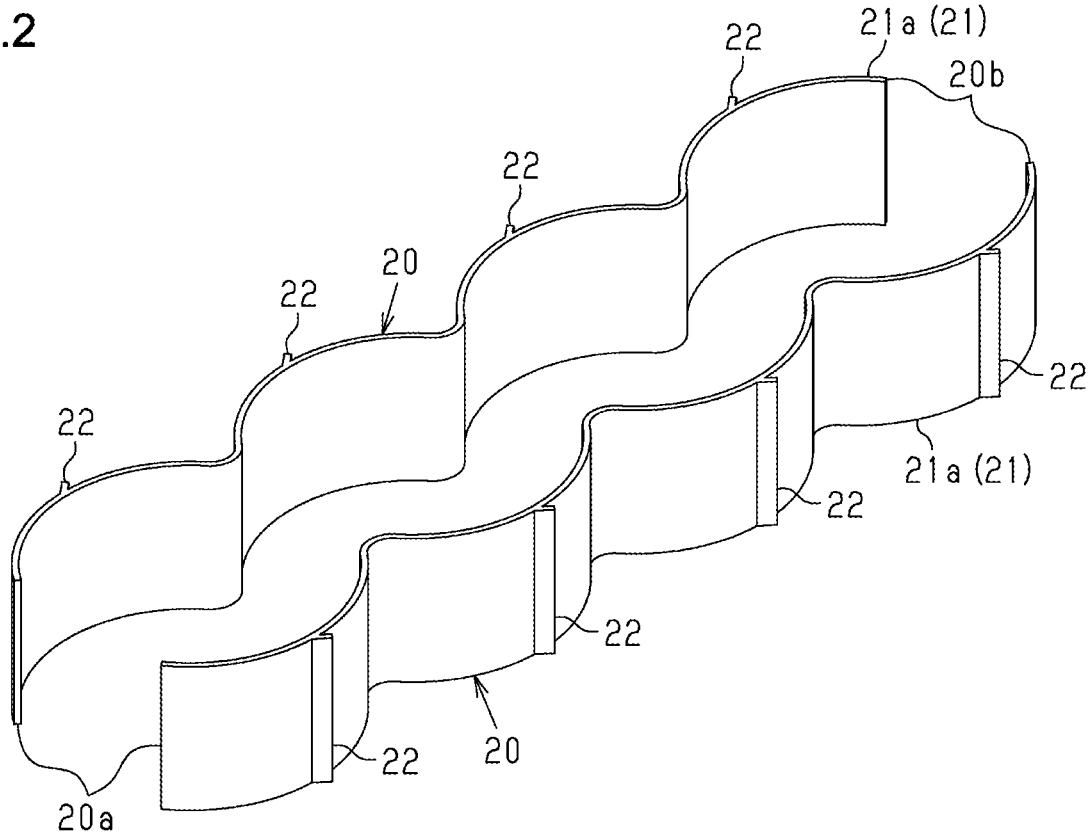
FIG. 2 is a perspective view of the water jacket spacer according to the first embodiment.

As shown in FIGS. 1 and 2, the spacer plate 21 includes four curved portions 21*a* that are curved and extend along the shape of the water jacket 11. In plan view, the water jacket spacer 20 extends from a side surface of the first cylinder 17 to a side surface of the second cylinder 18. That is, one end 20*a* of the water jacket spacer 20 is located on the side surface of the first cylinder 17, and the other end 20*b* of the water jacket spacer 20 is located on the side surface of the second cylinder 18.

As shown in FIG. 4, the length of the water jacket spacer 20 in the height direction Z is smaller than the length of the water jacket 11. The water jacket spacer 20 is in contact with the bottom wall 14 of the water jacket 11.

As shown in FIGS. 1 and 2, the spacer plate 21 includes four conversion portions 22 protruding in the radial direction. The conversion portions 22 are each located at a portion of the curved portion 21*a* that overlaps the center 16 of a corresponding cylinder 15 in the longitudinal direction X.

Figure 3:
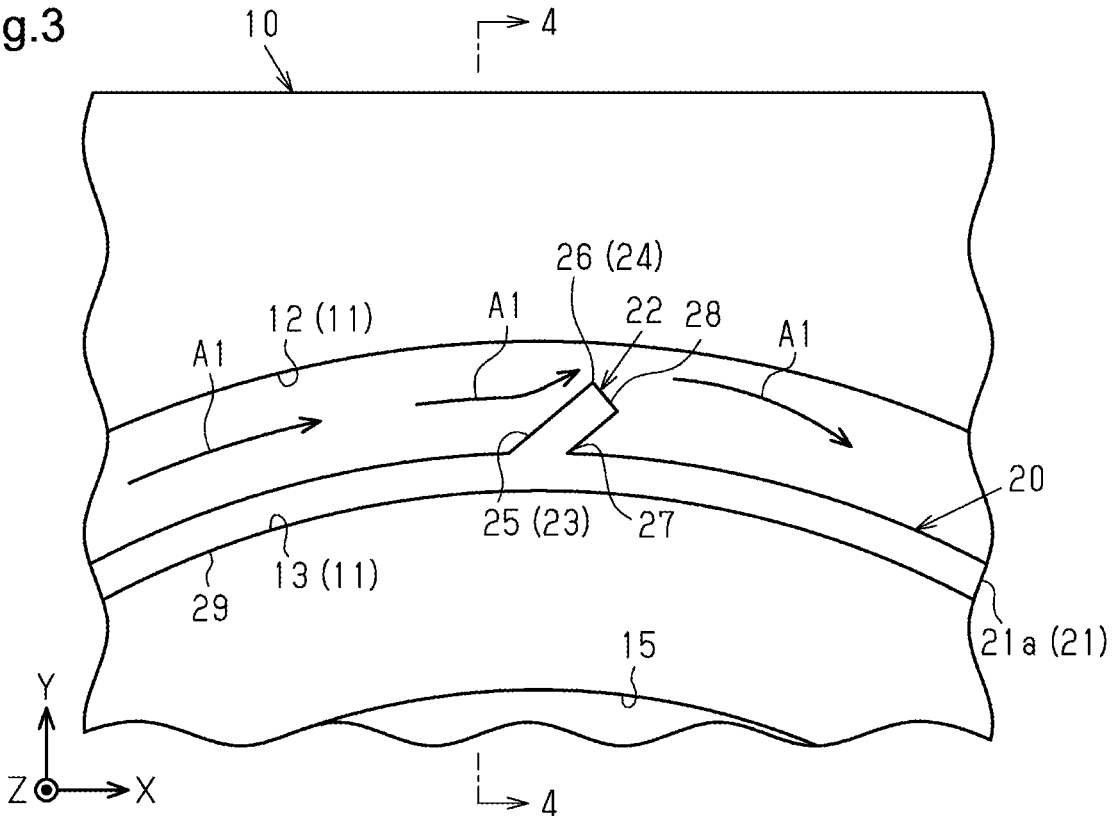
FIG. 3 is an enlarged plan view of the surroundings of the protruding piece according to the first embodiment.

As shown in FIGS. 3 and 4, the conversion portion 22 has an action surface 23 on which the pressure of the coolant flowing through the water jacket 11 acts.

In the present embodiment, the conversion portion 22 is a protrusion 24 that protrudes toward the outer side from the spacer plate 21. The protrusion 24 includes an inclined surface 25 serving as the action surface 23. A downstream portion of the inclined surface 25 in the flow direction of the coolant in the water jacket 11 is located on the outer side of an upstream portion of the inclined surface 25.

In the present embodiment, the protrusion 24 is a plate-like protruding piece 26 having a basal end 27 connected to the spacer plate 21 and a distal end 28 located on the outer side of the basal end 27. The distal end 28 is located downstream of the basal end 27. The protruding piece 26 has the inclined surface 25 serving as the action surface 23. The inclined surface 25 is an upstream surface of two surfaces defining the thickness of the protruding piece 26.

The length L1 in the radial direction between the distal end 28 and a facing surface 29 of the spacer plate 21 facing the inner-side inner wall 13 of the water jacket 11 is smaller than the length L2 of the water jacket 11 in the radial direction.

The operation of this embodiment will now be described.

As shown in FIG. 3, when the internal combustion engine is operated, coolant flows through the water jacket 11.

When the conversion portion 22 and the action surface 23 of the protruding piece 26, which is an example of the conversion portion 22, are pushed by the coolant flowing through the water jacket 11, a force pushing the spacer plate 21 toward the inner side is transmitted from the protruding piece 26 to the spacer plate 21. Further, since the action surface 23 is the inclined surface 25, the force pushing the spacer plate 21 toward the inner side is generated as a component of the force pushing the action surface 23 by the coolant.

The advantages of the present embodiment will now be described.

(1-1) The spacer plate 21 is pushed toward the inner-side inner wall 13 of the water jacket 11 by the protruding piece 26. Thus, a gap is less likely to be formed between the spacer plate 21 and the inner-side inner wall 13 of the water jacket 11. As a result, the coolant is less likely to flow between the spacer plate 21 and the inner-side inner wall 13 of the water jacket 11. This limits an increase in the viscosity of the lubricating oil in the cylinder 15 caused by the inner-side inner wall 13 of the water jacket 11 being cooled by the coolant. As a result, the deterioration of the fuel efficiency of the internal combustion engine is limited.

(1-2) The protrusion 24 protruding toward the outer side are arranged on the spacer plate 21. This simplifies the structure of the conversion portion 22.

(1-3) The protruding piece 26 is used as the protrusion 24. Such a simple structure allows the spacer plate 21 to be pushed toward the inner-side inner wall 13 of the water jacket 11.

(1-4) The length L1 in the radial direction between the distal end 28 and the facing surface 29 of the spacer plate 21 facing the inner-side inner wall 13 of the water jacket 11 is smaller than the length L2 of the water jacket 11 in the radial direction.

Thus, when the water jacket spacer 20 is inserted into the water jacket 11 and disposed inside the water jacket 11, a gap can be provided between the water jacket spacer 20 and each of the outer-side inner wall 12 and the inner-side inner wall 13 of the water jacket 11. This limits abrasion of the water jacket spacer 20 and the water jacket 11 due to friction between the water jacket spacer 20 and the water jacket 11.

Second Embodiment

Hereinafter, a second embodiment of the cylinder block 10 will be described with reference to FIGS. 5A to 7. In the second embodiment, since the configuration of the water jacket spacer 20 is different from that of the first embodiment, the difference from the first embodiment will be mainly described. In the second embodiment, components that are the same as or correspond to those in the first embodiment are denoted by the same reference numerals, and redundant description thereof will be omitted.

Figures 5A, 5B:
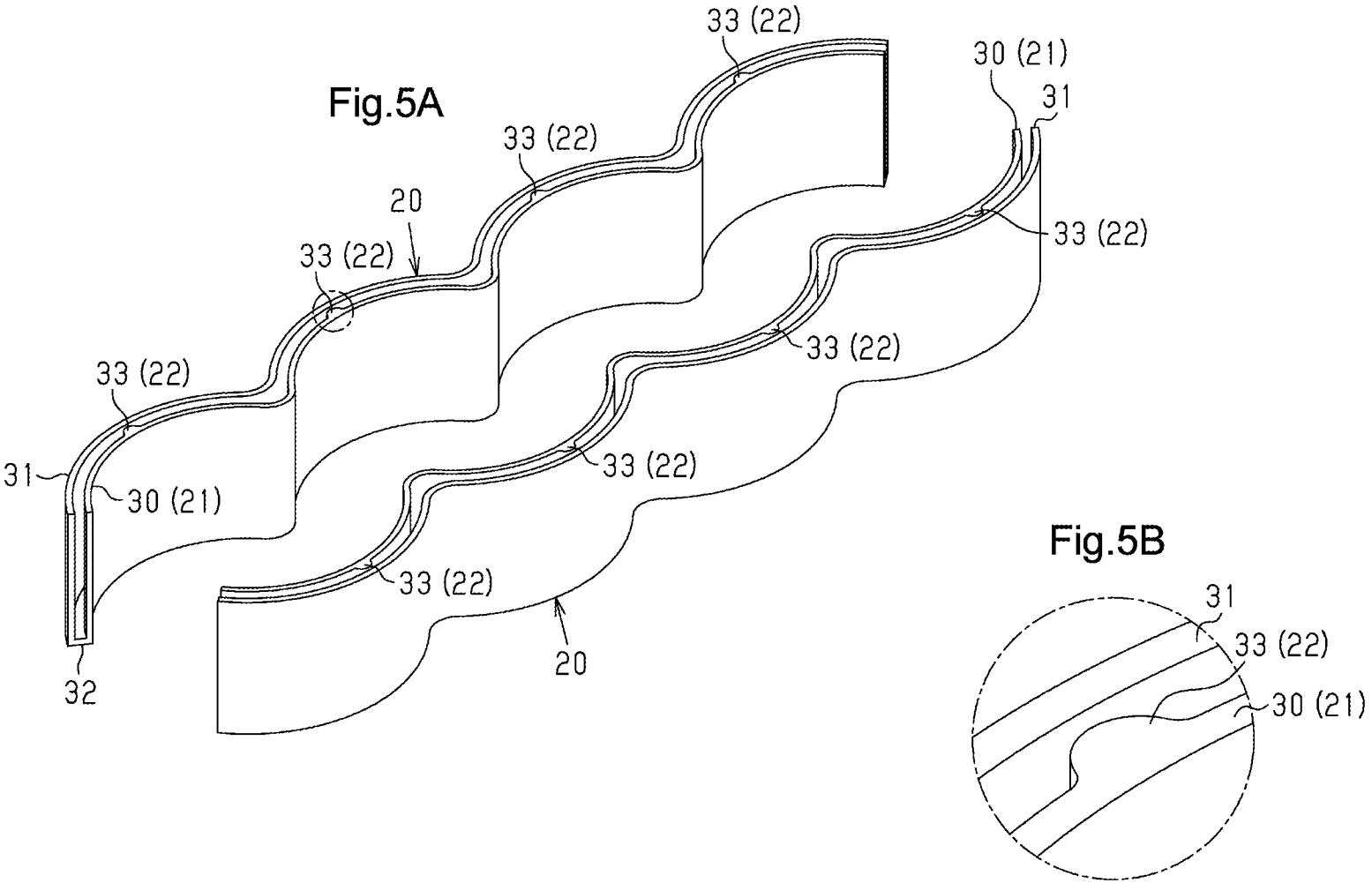
FIG. 5A is a perspective view of the water jacket spacer according to a second embodiment.
FIG. 5B is an enlarged perspective view of the surroundings of thick portions according to the second embodiment.

As shown in FIGS. 5A and 5B, the water jacket spacer 20 includes a first spacer plate 30 serving as the spacer plate 21, a second spacer plate 31, a coupling portion 32, and thick portions 33 each serving as the conversion portion 22.

The second spacer plate 31 is disposed on the outer side of the first spacer plate 30.

The first spacer plate 30 and the second spacer plate 31 have a wavy shape curved in conformance with the shape of the water jacket 11.

Figure 7:
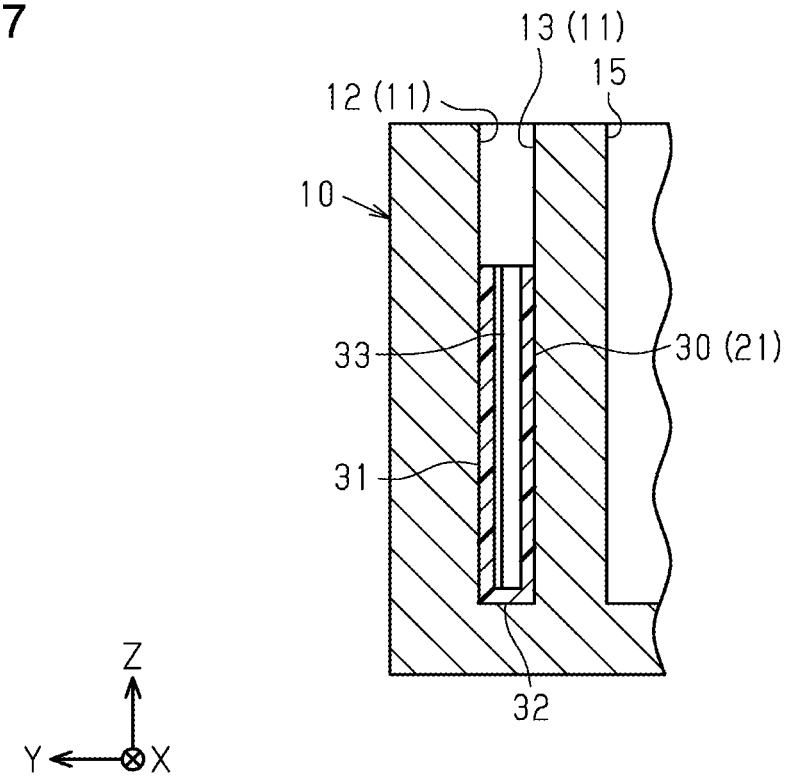
FIG. 7 is a cross-sectional view taken along line 7-7 in FIG. 6.

As shown in FIG. 7, the lowest point of the first spacer plate 30 and the lowest point of the second spacer plate 31 in the height direction Z are coupled to each other by the coupling portion 32. The coupling portion 32 is provided over the entire lowest points of the first spacer plate 30 and the second spacer plate 31 along the water jacket spacer 20.

Figure 6:
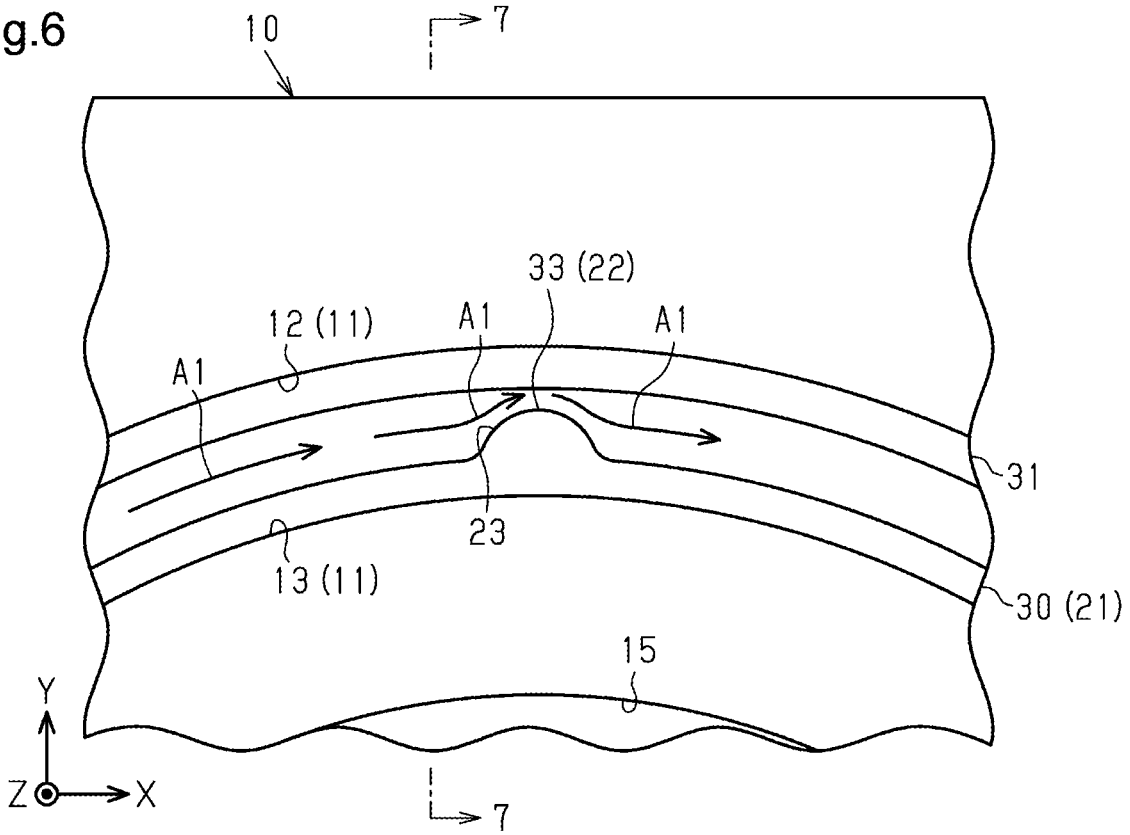
FIG. 6 is an enlarged plan view of the surroundings of a thick portion according to the second embodiment.

As shown in FIG. 6, the thick portion 33 is provided on the first spacer plate 30. The thick portion 33 has a portion with a thickness in the radial direction that increases toward the downstream side of the water jacket 11. The surface of the thick portion 33 on the upstream side of a position at which the thickness in the radial direction is maximum serves as the action surface 23.

The operation of this embodiment will now be described.

As shown in FIG. 6, when the internal combustion engine is operated, coolant flows through the water jacket 11.

When the action surface 23 of the thick portion 33 is pushed by the coolant flowing through the water jacket 11, a force pushing the spacer plate 21 (the first spacer plate 30) toward the inner side is transmitted from the thick portion 33 to the spacer plate 21. Further, the thick portion 33 has the portion with the thickness in the radial direction that increases toward the downstream side of the water jacket 11. Thus, the force pushing the spacer plate 21 toward the inner side is generated as a component force of the force pushing the action surface 23 by the coolant. As a result, the spacer plate 21 and the second spacer plate 31 are forced so that they are separated from each other in the radial direction. Accordingly, a gap is less likely to be formed between the spacer plate 21 and the inner-side inner wall 13 of the water jacket 11.

The advantage of the present embodiment will be described.

(2-1) Since the spacer plate 21 is pushed toward the inner side, a gap is less likely to be formed between the spacer plate 21 and the inner-side inner wall 13 of the water jacket 11. This limits an increase in the viscosity of the lubricating oil in the cylinder 15 caused by the inner-side inner wall 13 of the water jacket 11 being cooled by the coolant. As a result, the deterioration of the fuel efficiency of the internal combustion engine is limited.

Third Embodiment

Hereinafter, a third embodiment of the cylinder block 10 will be described with reference to FIGS. 8A to 10. In the third embodiment, since the configuration of the water jacket spacer 20 is different from that of the first embodiment, the difference from the first embodiment will be mainly described. In the third embodiment, components that are the same as or correspond to those of the first embodiment are denoted by the same reference numerals, and redundant description thereof will be omitted.

Figures 8A, 8B:
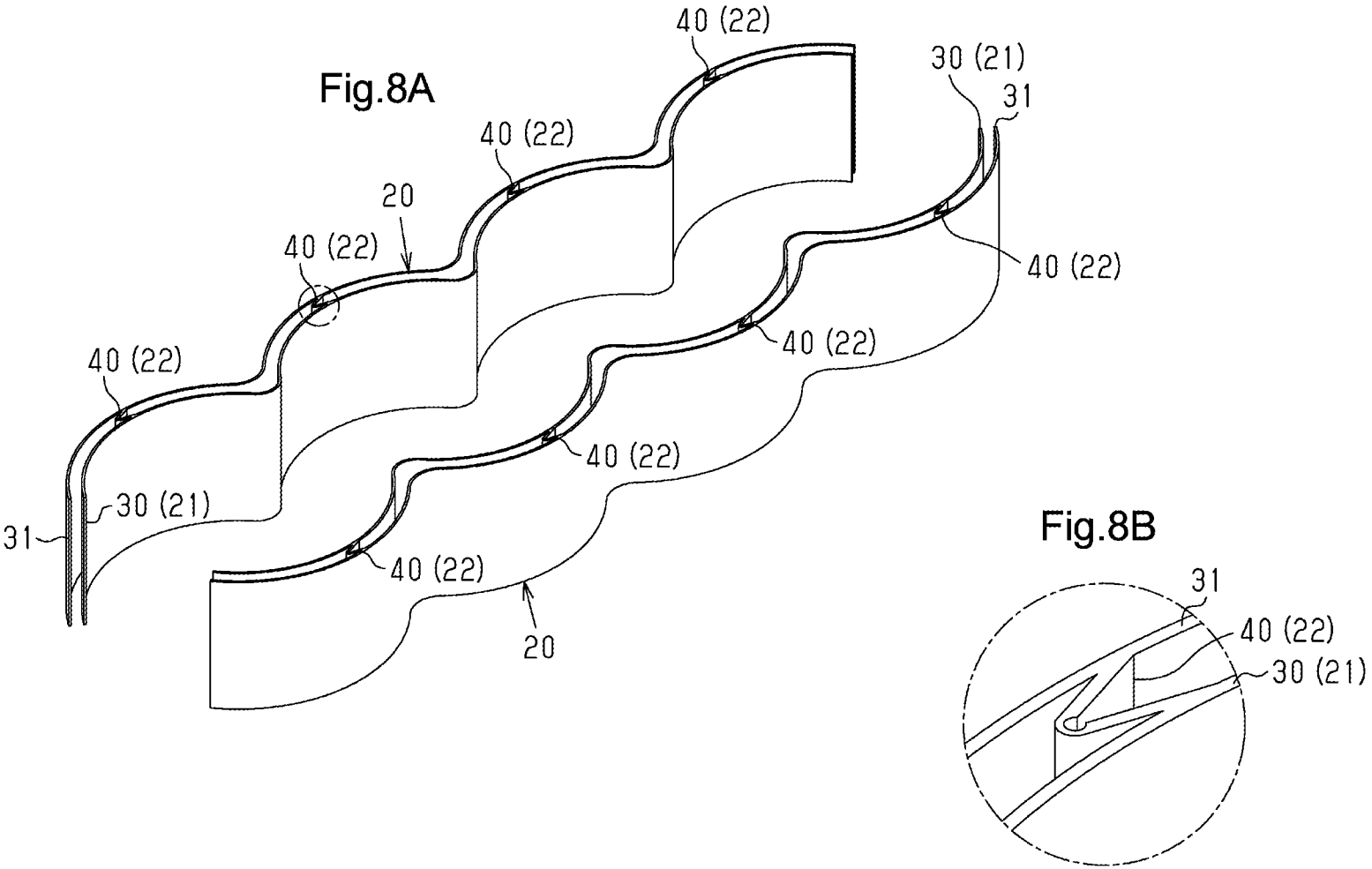
FIG. 8A is a perspective view of the water jacket spacer according to a third embodiment.
FIG. 8B is an enlarged perspective view of the surroundings of the coupling portion according to the third embodiment.

As shown in FIGS. 8A and 8B, the water jacket spacer 20 includes the first spacer plate 30 serving as the spacer plate 21, the second spacer plate 31, and coupling portions 40 respectively serving as the conversion portions 22.

The second spacer plate 31 is disposed on the outer side of the first spacer plate 30 and spaced apart from the first spacer plate 30.

The first spacer plate 30 and the second spacer plate 31 have a wavy shape curved in conformance with the shape of the water jacket 11.

Figure 9:
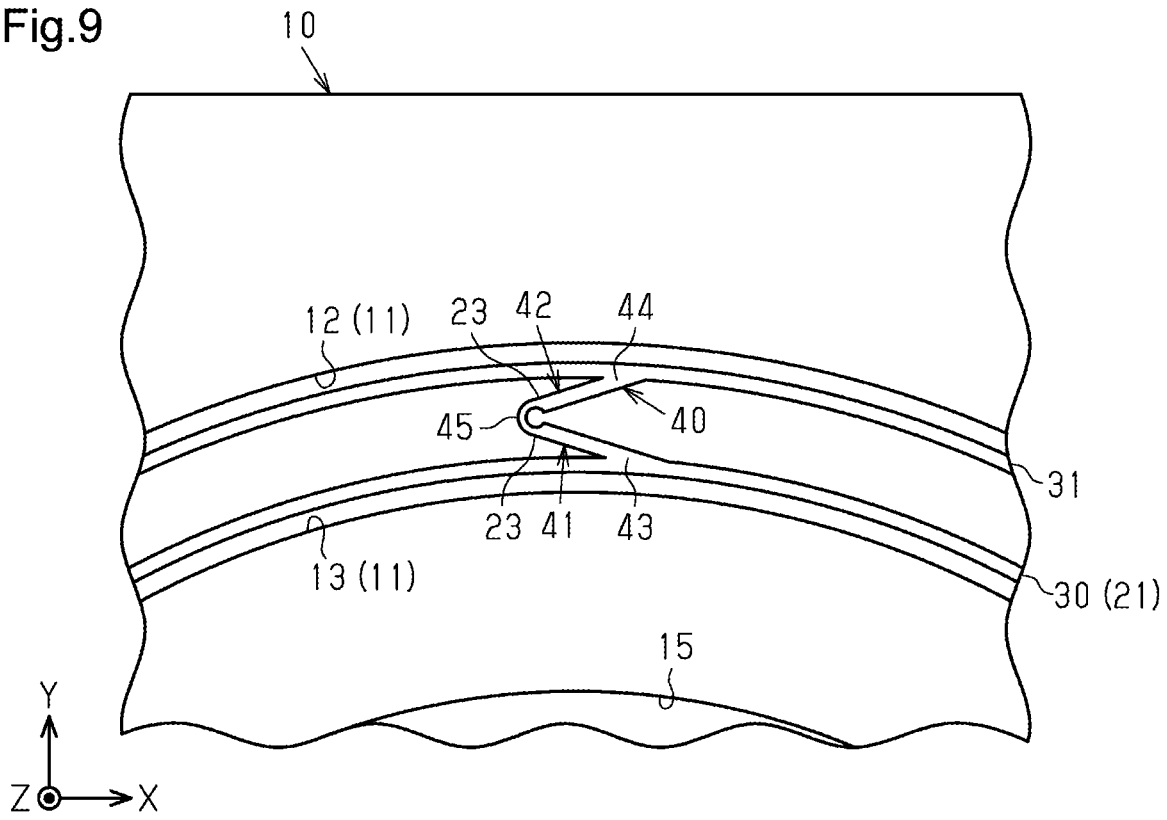
FIG. 9 is an enlarged plan view of the coupling portion, showing a state in which the coolant is not flowing around the coupling portion according to the third embodiment.
Figure 10:
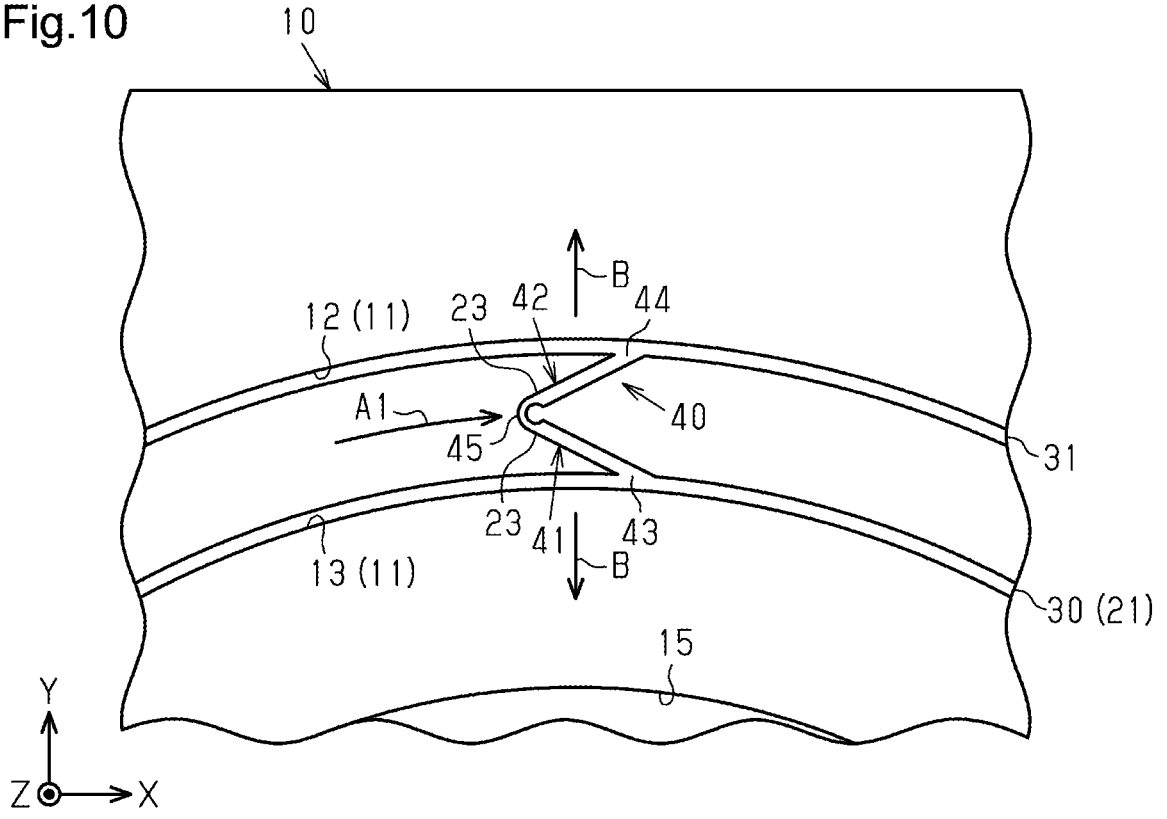
FIG. 10 is an enlarged plan view of the coupling portion, showing a state in which the coolant is flowing around the coupling portion according to the third embodiment.

As shown in FIGS. 9 and 10, the coupling portion 40 includes a first extension piece 41 and a second extension piece 42. The thickness of the first extension piece 41 and the thickness of the second extension piece 42 may be equal to or different from each other. The first extension piece 41 extends toward the outer side from the first connection portion 43 of the first spacer plate 30 and extends toward the upstream side of the water jacket 11. The second extension piece 42 extends toward the outer side from an end 45 of the first extension piece 41 on the outer side, extends downstream, and is connected to the second connection portion 44 of the second spacer plate 31. The first extension piece 41 is configured to allow the end 45 to move in the flow direction by pivoting around the first connection portion 43. The second extension piece 42 is configured to allow the end 45 to move in the flow direction by pivoting around the second connection portion 44. The end 45 is thinner than the first extension piece 41 and the second extension piece 42 and is thus deformed more easily than the first extension piece 41 and the second extension piece 42.

In the third embodiment, the upstream surface of the two surfaces defining the thickness of the first extension piece 41 and the upstream surface of the two surfaces defining the thickness of the second extension piece 42 serve as the action surfaces 23.

The sum of the length from the first connection portion 43 to the end 45, the length from the second connection portion 44 to the end 45, the thickness of the first spacer plate 30, and the thickness of the second spacer plate 31 is greater than the distance in the radial direction between the inner-side inner wall 13 of the water jacket 11 facing the first spacer plate 30 and the outer-side inner wall 12 of the water jacket 11 facing the second spacer plate 31.

The operation of this embodiment will now be described.

First, as shown in FIG. 9, in a state in which coolant is not flowing through the water jacket 11, a gap is provided between the first spacer plate 30 and the inner-side inner wall 13 of the water jacket 11 and between the second spacer plate 31 and the outer-side inner wall 12 of the water jacket 11.

Next, as indicated by an arrow A1 in FIG. 10, when the pressure of the coolant flowing from the upstream side (left side in FIG. 10) of the water jacket 11 is applied to the coupling portion 40, the first extension piece 41 and the second extension piece 42 pivot with respect to the end 45. When the first extension piece 41 and the second extension piece 42 pivot, the end 45 is deformed such that the angle formed by the first extension piece 41 and the second extension piece 42 increases.

As a result, as shown by an arrow B in FIG. 10, the first spacer plate 30 and the second spacer plate 31 are forced so that they are separated from each other in the radial direction. Thus, a gap is less likely to be formed between the first spacer plate 30 and the inner-side inner wall 13 of the water jacket 11.

The advantage of the present embodiment will be described.

(3-1) The water jacket spacer 20 includes the first spacer plate 30, the second spacer plate 31, and the coupling portion 40. The coupling portion 40 includes the first extension piece 41 and the second extension piece 42. The first extension piece 41 is configured to be pivotal with respect to the first spacer plate 30. The second extension piece 42 is configured to be pivotal with respect to the second spacer plate 31. The first extension piece 41 and the second extension piece 42 are pivotally connected to each other at the end 45.

This configuration provides the above-described operation and thus limits an increase in viscosity of the lubricating oil in the cylinder 15 caused by the inner-side inner wall 13 of the water jacket 11 being cooled by the coolant. As a result, the deterioration of the fuel efficiency of the internal combustion engine is limited.

Further, the configuration brings the first spacer plate 30 and the second spacer plate 31 closer to each other in the radial direction by pivoting the first extension piece 41 and the second extension piece 42. Thus, the water jacket spacer 20 can be inserted into the water jacket 11 such that the first spacer plate 30 and the second spacer plate 31 do not come into contact with the inner-side inner wall 13 and the outer-side inner wall 12 of the water jacket 11, respectively. This limits abrasion of the water jacket spacer 20 and the water jacket 11 due to friction between the water jacket spacer 20 and the water jacket 11.

Fourth Embodiment

Hereinafter, a fourth embodiment of the cylinder block 10 will be described with reference to FIGS. 11 and 12. In the fourth embodiment, the configuration of the water jacket spacer 20 is the same as that of the third embodiment, but the method for coupling the water jacket spacer 20 to the water jacket 11 is different. In the fourth embodiment, the same components as those in the third embodiment are denoted by the same reference numerals, and redundant description thereof will be omitted.

Figure 11:
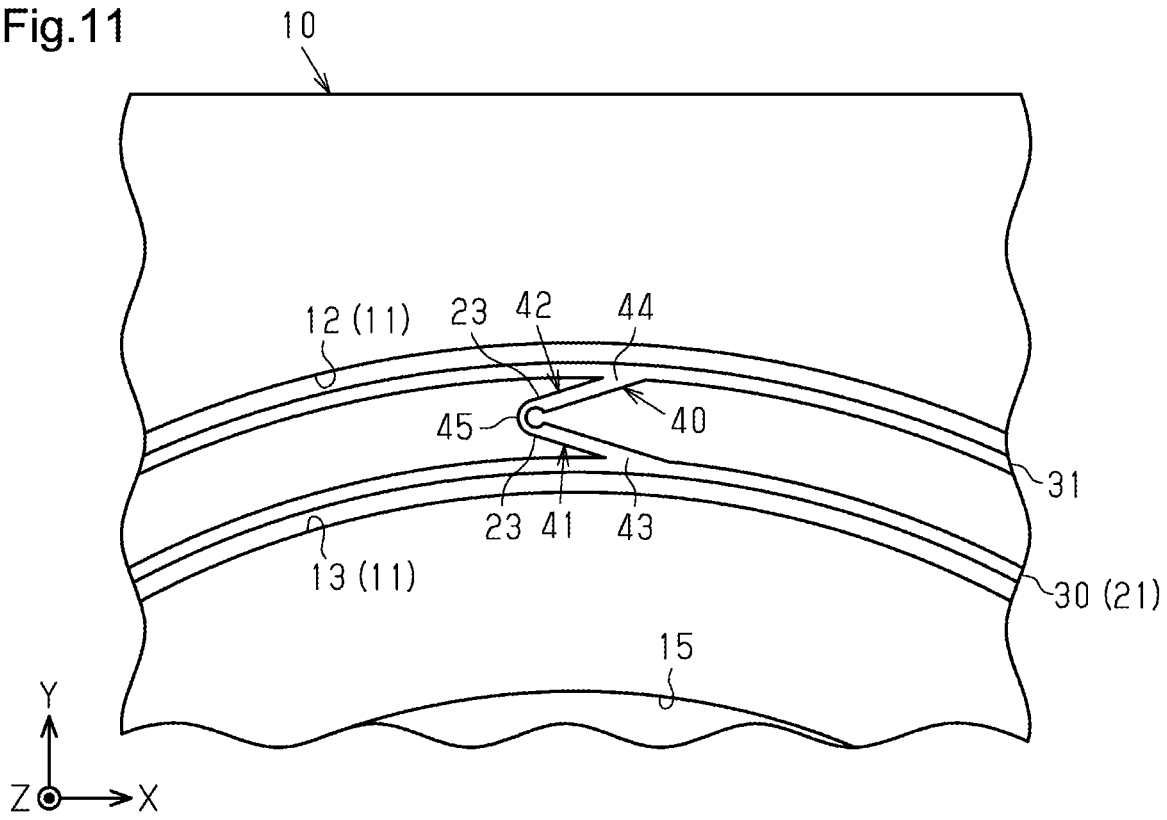
FIG. 11 is a plan view illustrating an insertion step according to a fourth embodiment.

First, as shown in FIG. 11, the water jacket spacer 20 is inserted into the water jacket 11 while providing a gap between the first spacer plate 30 and the inner-side inner wall 13 of the water jacket 11 and a gap between the second spacer plate 31 and the outer-side inner wall 12 of the water jacket 11 (insertion step).

Figure 12:
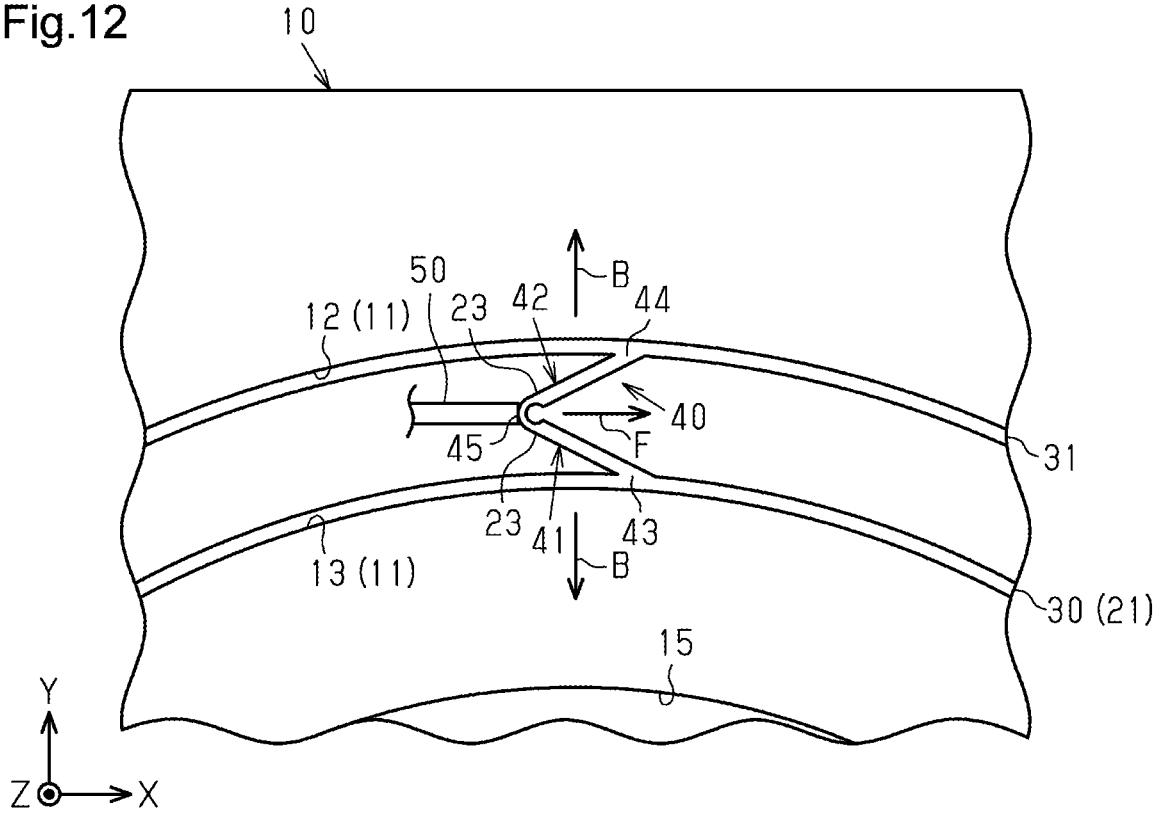
FIG. 12 is a plan view illustrating a separating step according to the fourth embodiment.

Next, as shown in FIG. 12, a jig 50 is used to apply a force from the upstream side to the downstream side as indicated by an arrow F to push the coupling portion 40, thereby pivoting the first extension piece 41 and the second extension piece 42.

Then, as indicated by an arrow B in FIG. 12, the first spacer plate 30 and the second spacer plate 31 are forced so that they are separated from each other in the radial direction (separating step).

The operation of this embodiment will now be described.

In the separating step, since the first spacer plate 30 and the second spacer plate 31 are forced so that they are separated from each other in the radial direction, a gap is less likely to be formed between the first spacer plate 30 and the inner-side inner wall 13 of the water jacket 11. This limits an increase in the viscosity of the lubricating oil in the cylinder 15 caused by the inner-side inner wall 13 of the water jacket 11 being cooled by the coolant. As a result, the deterioration of the fuel efficiency of the internal combustion engine is limited.

The advantage of the present embodiment will be described.

(4-1) The coupling method for the water jacket spacer 20 includes the insertion step and the separating step.

This method provides the above-described operation and thus limits an increase in the viscosity of the lubricating oil in the cylinder 15 caused by the inner-side inner wall 13 of the water jacket 11 being cooled by the coolant. As a result, the deterioration of the fuel efficiency of the internal combustion engine is limited.

In the method, the inserting step allows the water jacket spacer 20 to be inserted into the water jacket 11 such that the first spacer plate 30 and the second spacer plate 31 do not come into contact with the inner-side inner wall 13 and the outer-side inner wall 12 of the water jacket 11, respectively. This limits abrasion of the water jacket spacer 20 and the water jacket 11 due to friction between the water jacket spacer 20 and the water jacket 11.

MODIFICATIONS

The present embodiment can be modified as follows. The present embodiment and the following modifications can be implemented in combination with each other as long as there is no technical contradiction.

In the first to fourth embodiments, at least one of the four conversion portion 22 may be provided. In addition, the conversion portion 22 does not have to be located at the position overlapping the center 16 of each cylinder 15 in the longitudinal direction X. The conversion portion 22 may be located at any position in the longitudinal direction X in the water jacket spacer 20.

In the first to fourth embodiments, the ends 20*a* of the two water jacket spacers 20 may be connected to each other. Further, the ends 20*b* may be connected to each other.

Even in this case, if the water jacket spacer 20 is made of resin, the spacer plate 21 is elastically deformed by a force pushing the spacer plate 21 toward the inner side. This provides the above-described operational advantage (1-1).

In addition, when the water jacket spacer 20 is made of metal, the spacer plate 21 is deformed by a force pushing the spacer plate 21 toward the inner side by, for example, making the portions connecting the ends 20*a* to each other and the portion connecting the ends 20*b* to each other thinner than the spacer plate 21 in the radial direction. This provides the above-described operational advantage (1-1).

Figure 13:
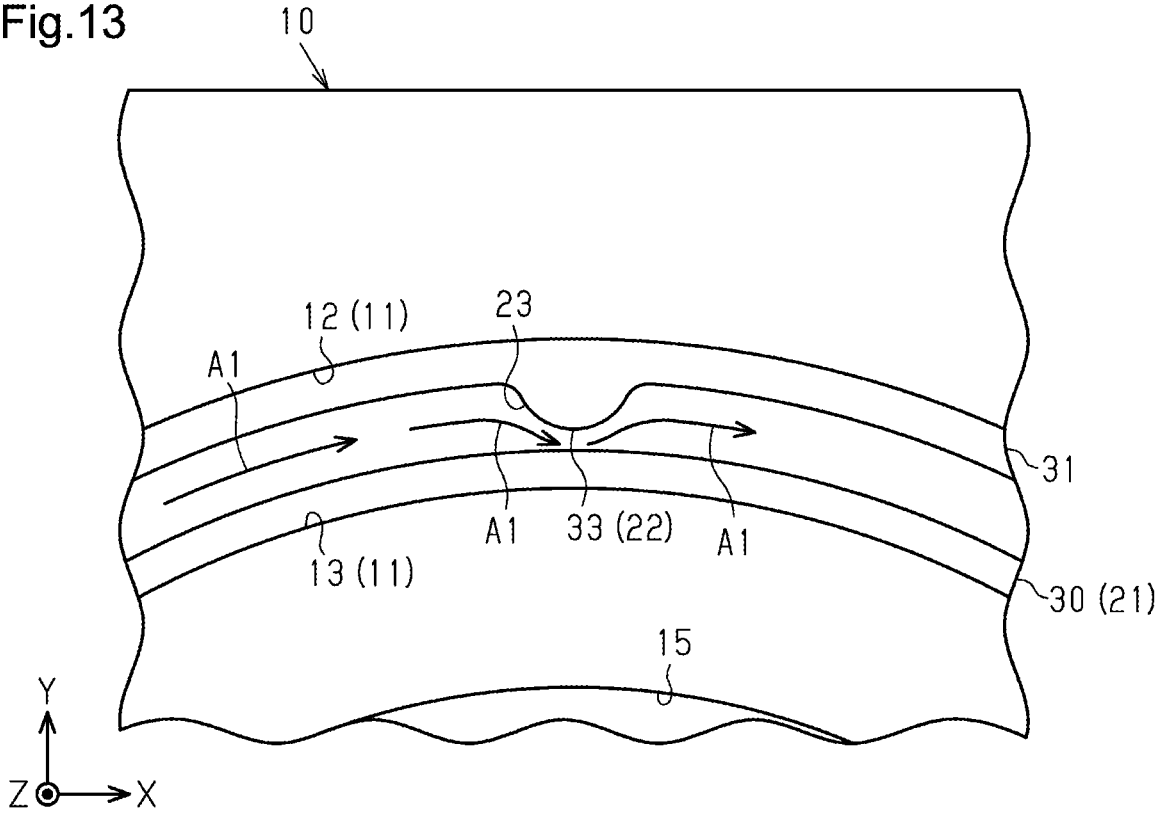
FIG. 13 is an enlarged plan view of the surroundings of the thick portion according to a modification of the second embodiment.

As shown in FIG. 13, in the second embodiment, the thick portion 33 only needs to be located in the second spacer plate 31. Even in this case, the above-described operational advantage (2-1) is provided.

Figure 14:
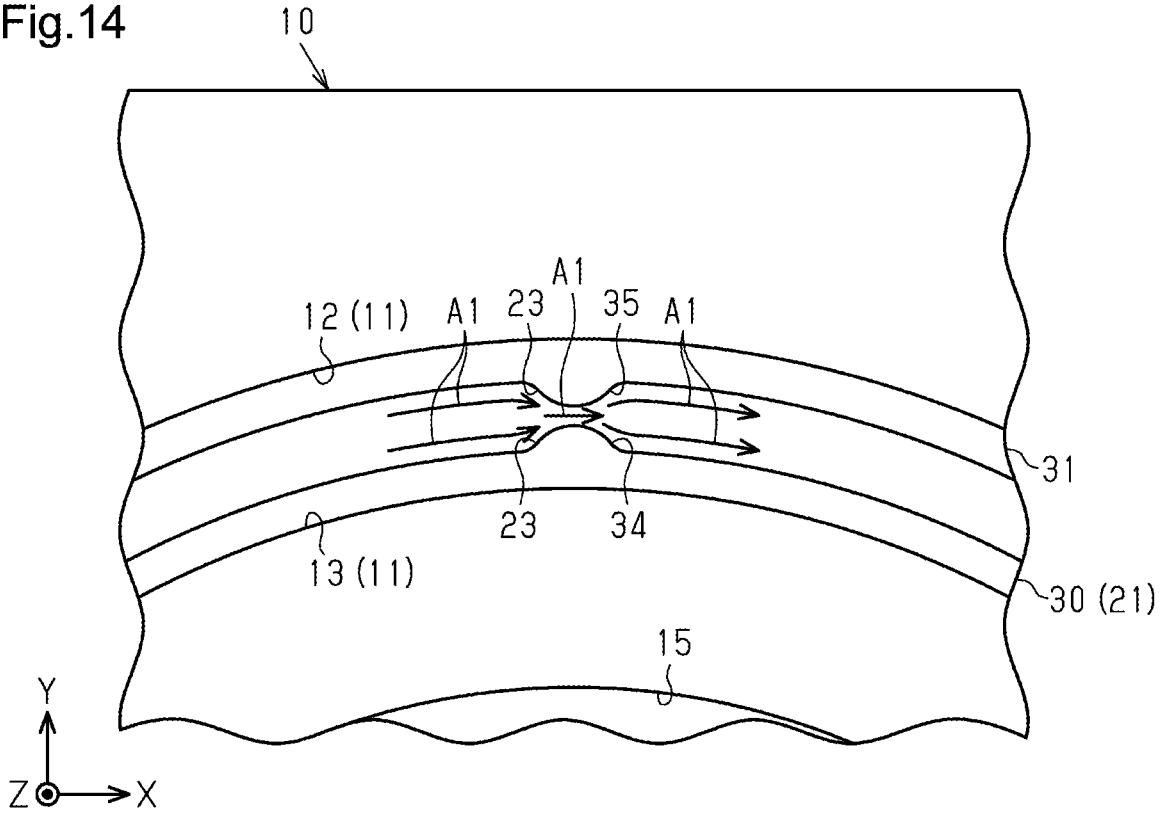
FIG. 14 is an enlarged plan view of the surroundings of the thick portion according to a modification of the second embodiment.

As shown in FIG. 14, in the second embodiment, the configuration of the water jacket spacer 20 may be changed as follows. The first thick portion 34 is provided on the first spacer plate 30, the second thick portion 35 is provided on the second spacer plate 31, and the first thick portion 34 and the second thick portion 35 face each other. Even in this case, the above-described operational advantage (2-1) is provided.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A cylinder block comprising:

a water jacket surrounding a cylinder of an internal combustion engine; and a water jacket spacer disposed inside the water jacket, wherein a direction toward a center of the cylinder in a radial direction of the cylinder is defined as an inner side, a direction away from the center in the radial direction is defined as an outer side, the water jacket spacer includes:

a spacer plate; and a conversion portion protruding from the spacer plate in the radial direction, the conversion portion has an action surface on which a pressure of coolant flowing through the water jacket acts, and the conversion portion is configured to convert a force applied to the action surface by the pressure of the coolant into a force pushing the spacer plate toward the inner side.

2. The cylinder block according to claim 1, wherein the conversion portion is a protrusion protruding from the spacer plate to the outer side, the protrusion includes an inclined surface serving as the action surface, and a downstream portion of the inclined surface in a flow direction of the coolant in the water jacket is located on the outer side of an upstream portion of the inclined surface.

3. The cylinder block according to claim 2, wherein the protrusion is a plate-shaped protruding piece having a basal end connected to the spacer plate and a distal end located on the outer side of the basal end, the distal end is located downstream of the basal end, the protruding piece has the inclined surface serving as the action surface, and the inclined surface is an upstream surface of two surfaces defining a thickness of the protruding piece.

4. The cylinder block according to claim 3, wherein a length in the radial direction between the distal end and a facing surface of the spacer plate facing an inner wall on the inner side of the water jacket is smaller than a length of the water jacket in the radial direction.

5. The cylinder block according to claim 1, wherein the water jacket spacer includes:

a first spacer plate serving as the spacer plate; and a second spacer plate disposed on the outer side of the first spacer plate and coupled to the first spacer plate, at least one of the first spacer plate and the second spacer plate includes a thick portion serving as the conversion portion, the thick portion has a portion with a thickness in the radial direction that increases toward a downstream side in a flow direction of the coolant in the water jacket, and the action surface is a surface of the thick portion on an upstream side of a position at which the thickness is maximum.

6. The cylinder block according to claim 1, wherein the water jacket spacer includes:

a first spacer plate serving as the spacer plate; and a second spacer plate disposed on the outer side of the first spacer plate and spaced apart from the first spacer plate, a coupling portion that couples the first spacer plate to the second spacer plate; and the conversion portion is the coupling portion, and the coupling portion includes:

a first extension piece that extends toward the outer side from a first connection portion of the first spacer plate and extends upstream in a flow direction of the coolant in the water jacket; and a second extension piece that extends toward the outer side from an end of the first extension piece on the outer side, extends downstream, and is connected to a second connection portion of the second spacer plate, the first extension piece is configured to allow the end to move in the flow direction by pivoting around the first connection portion, the second extension piece is configured to allow the end to move in the flow direction by pivoting around the second connection portion, an upstream surface of two surfaces defining a thickness of the first extension piece and an upstream surface of two surfaces defining a thickness of the second extension piece each serve as the action surface, and a sum of a length from the first connection portion to the end, a length from the second connection portion to the end, a thickness of the first spacer plate, and a thickness of the second spacer plate is greater than a distance in the radial direction between an inner wall of the water jacket facing the first spacer plate and an inner wall of the water jacket facing the second spacer plate.

7. The cylinder block according to claim 1, wherein the spacer plate includes a curved portion that is curved and extends along a shape of a side surface of the cylinder, and the conversion portion protrudes from the curved portion in the radial direction.

8. The cylinder block according to claim 1, wherein the cylinder includes cylinders, the cylinders are arranged straight, and the water jacket spacer extends from a side surface of a first cylinder located at one end in an arrangement direction of the cylinders to a side surface of a second cylinder located at the other end in the arrangement direction.

9. A coupling method for a water jacket spacer, wherein the water jacket spacer is coupled to a water jacket disposed to surround a cylinder in a cylinder block of an internal combustion engine, a direction toward a center of the cylinder in a radial direction of the cylinder is defined as an inner side, a direction away from the center in the radial direction is defined as an outer side, a length of the water jacket in the radial direction is greater than a length of the water jacket spacer in the radial direction, the water jacket spacer includes:

a first spacer plate;

a second spacer plate; and a coupling portion that couples the first spacer plate to the second spacer plate, the second spacer plate is disposed on the outer side of the first spacer plate and spaced apart from the first spacer plate, the coupling portion includes:

a first extension piece that extends toward the outer side from a first connection portion of the first spacer plate and extends upstream in a flow direction of the coolant in the water jacket; and a second extension piece that extends toward the outer side from an end of the first extension piece on the outer side, extends downstream, and is connected to a second connection portion of the second spacer plate, the first extension piece is configured to allow the end to move in the flow direction by pivoting around the first connection portion, the second extension piece is configured to allow the end to move in the flow direction by pivoting around the second connection portion, a sum of a length from the first connection portion to the end and a length from the second connection portion to the end is greater than a distance in the radial direction between an inner wall of the water jacket facing the first spacer plate and an inner wall of the water jacket facing the second spacer plate, and the coupling method comprises:

inserting the water jacket spacer into the water jacket while providing a gap between the first spacer plate and the inner wall of the water jacket on the inner side and a gap between the second spacer plate and the inner wall of the water jacket on the outer side; and pushing the coupling portion from an upstream side to a downstream side to pivot the first extension piece and the second extension piece and force the first spacer plate and the second spacer plate so that the first spacer plate and the second spacer plate are separated from each other in the radial direction.

* * * * *